United States Patent [19]

McInturff

[11] Patent Number: 4,828,035

[45] Date of Patent: May 9, 1989

[54] SUBSEA GUIDEPOST LATCH MECHANISM AND METHOD FOR USING

[75] Inventor: Terry L. McInturff, Metairie, La.

[73] Assignee: Exxon Production Research Company, Houston, Tex.

[21] Appl. No.: 247,352

[22] Filed: Sep. 21, 1988

[51] Int. Cl.[4] ..... E21B 23/02; E21B 43/01; F16L 37/08

[52] U.S. Cl. ..... 166/339; 166/340; 166/342; 166/349; 403/322

[58] Field of Search ..... 166/338, 339, 340, 341, 166/342, 349, 351, 217, 209, 83, 86, 88; 285/315; 403/322; 294/86.17, 86.18, 86.24, 86.25

[56] References Cited

U.S. PATENT DOCUMENTS

| | | | |
|---|---|---|---|
| 1,875,357 | 9/1932 | Simmons . | |
| 2,602,513 | 7/1952 | Conrad | 166/179 |
| 3,358,752 | 12/1967 | Postlewaite | 166/349 X |
| 3,531,066 | 9/1970 | Baekken | 294/86.24 |
| 3,553,821 | 1/1971 | Postlewaite | 29/427 |
| 3,695,350 | 10/1972 | Petersen | 166/342 X |
| 3,874,448 | 4/1975 | McGowen, Jr. | 294/86.18 X |
| 4,132,147 | 1/1979 | Contaldo | 89/1.5 |
| 4,265,306 | 5/1981 | Stout | 166/237 |
| 4,379,488 | 4/1983 | Hamm | 294/86.18 X |
| 4,405,263 | 9/1983 | Hall | 405/224 |
| 4,439,068 | 3/1984 | Pokladnik | 285/315 X |
| 4,491,439 | 1/1985 | Watkins | 405/224 |
| 4,611,953 | 9/1986 | Owens | 405/169 X |
| 4,708,376 | 11/1987 | Jennings et al. | 285/315 |

*Primary Examiner*—Stephen J. Novosad

[57] ABSTRACT

A subsea guidepost latch mechanism which latches a guidepost to a guidepost-receptacle by means of an external snap ring on the guidepost and an internal groove in the guidepost-receptacle. The snap ring is held in the groove by a collet inside the snap ring which is forced outward by an inner mandrel in the guidepost when upward tension is placed on the mandrel by a guideline. The guidepost is released from the guidepost-receptacle by releasing tension on the guideline which allows the mandrel to drop, releasing outward force on the collet and the snap ring. This allows the snap ring to be pulled out of the guidepost-receptacle groove.

17 Claims, 2 Drawing Sheets

SUBSEA GUIDEPOST LATCH MECHANISM AND METHOD FOR USING

FIELD OF THE INVENTION

This invention is in the field of retrievable attachment of guidelines to undersea oil and gas well equipment.

BACKGROUND

When a subsea well has been drilled, the wellhead is typically terminated in a base or guide template which rests on the ocean floor. It is necessary from time to time to lower equipment from the surface of the ocean to the ocean floor and to attach or mate that equipment to other equipment or fixtures on the base. This requires a means for guiding the equipment being lowered to the vicinity of the base and for accurately aligning that equipment with its mating fixture on the base once it has arrived.

These guidance and alignment functions are served by guidelines which descend from the ocean surface to the tops of guideposts which rise from the base, preferably by being inserted in a guidepost-receptacle on the base designed for the purpose. Typically, the guidepost-receptacle will have an annular depression or groove on its inner surface and the guidepost will have retractable dogs or other locking features protruding from its outer surface. As the guidepost is inserted into the guidepost-receptacle, the retractable dogs snap outward into the groove when the guidepost reaches full insertion. The dogs then act as locking devices to retain the guidepost in the guidepost-receptacle until removal of the guidepost is required.

There are various methods for removal of a guidepost from a guidepost-receptacle for retrieval. The dogs can be retracted by downward force on a component of the guidepost, by frangible devices or by manipulation of the guidepost by a remotely operated vehicle on the ocean floor. Use of force on the top of the guidepost or a component thereof is undesirable because of the tendency to buckle the component, especially if it is very long. This effectively limits the guidepost length in order to prevent buckling. Use of frangible release mechanisms can be unreliable. Manipulation of the base of the guidepost or the guidepost-receptacle by a remotely operated vehicle can be impossible because the areas around the base are not always accessible.

SUMMARY OF THE INVENTION

The latch mechanism of this invention makes possible the release and retrieval of a guidepost from its guidepost-receptacle without applying compressive force to the guidepost or one of its components. This makes possible the use of guideposts of greater length than previously feasible. This latch mechanism also avoids the use of frangible devices and external manipulators when released in its normal mode. Use of this mechanism does not require diver assistance; therefore, it is suitable for deep water applications. Further, the latch mechanism of this invention can utilize a full bore receptacle which avoids lodging of small debris that could prevent latching of the guidepost to the receptacle.

Under normal operating conditions the locking and unlocking of the guidepost within the guidepost-receptacle is accomplished by the action of an inner mandrel within the guidepost as it is brought into or out of bearing with a collet operated snap ring carried by the guidepost.

As long as tension is maintained on the guideline, the mandrel forces the expandable collet outward, which keeps the lower snap ring pushed outward into the receptacle groove, holding the guidepost securely in the receptacle.

Release under normal circumstances is effected by slacking off on the guideline, which drops the inner mandrel in the guidepost, allowing the collet at the lower end of the mandrel to contract, thereby relieving pressure on the lower snap ring. Simultaneously, a shoulder on the upper end of the mandrel drops, allowing a retrieval ring carried by the guidepost to be pushed inward above the shoulder by a drop collar. After slackening of the guideline releases the lower snap ring, and after dropping a drop collar from the surface engages the retrieval ring, resumption of tension on the guideline pulls the mandrel shoulder up against the retrieval ring for pulling the guidepost to the surface. This makes possible the pulling of the guidepost from the receptacle, popping the lower snap ring out of the groove in the receptacle.

Additionally, in the event that the normal mode of release fails, the mandrel has a designed break point which allows the guidepost to be released by pulling on the guideline until the mandrel separates, releasing the collet and lower snap ring. Finally, if the mandrel becomes stuck in the latched position, release pins are provided which can be manipulated by a remotely operated vehicle to forcibly drive the mandrel down, releasing the collet and lower snap ring.

DETAILED DESCRIPTION OF THE INVENTION

Figure 1:
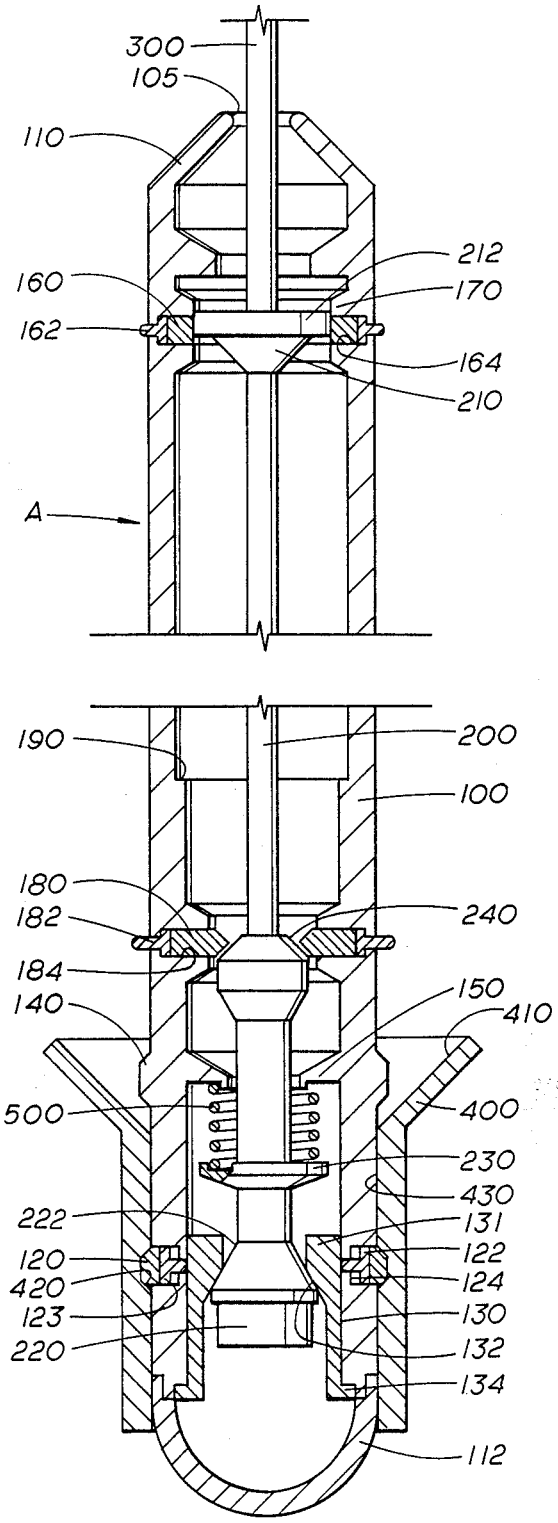
FIG. 1 is a sectional view of the latch mechanism of the present invention shown in the latched position.

As shown in FIG. 1, guidepost A comprises a hollow cylindrical guidepost housing 100 which contains an inner mandrel 200 the upper portion of which is joined to a guideline 300. The mandrel 200 can extend out of housing 100 through opening 105 to its point of connection with guideline 300. Alternatively, guideline 300 can be joined to mandrel 200 within housing 100.

The exterior surface of guidepost housing 100 mates with the interior surface of a guidepost-receptacle 400 which is mounted on a base (not shown) on the ocean floor.

The latching and unlatching of guidepost A to guidepost-receptacle 400 is accomplished by the actions of a lower snap ring 120 carried on housing 100 which registers with a locking groove 420 provided on the interior surface of guidepost-receptacle 400. The action of the lower snap ring 120 is controlled through snap ring drive buttons 122 which are operated by an expandable collet 130 which is positioned within housing 100. The operation of the collet 130 is in turn controlled by and dependent upon the positioning of an inner mandrel 200 carried within housing 100 with respect to various bearing surfaces and shoulders provided on the mandrel 200 with respect to and for cooperation with various bearing surfaces and shoulders provided as part of the interior surface structure of housing 100.

Guidepost A thus generally comprises a cylindrical housing 100, an inner mandrel 200, located within housing 100 and joined at its upper end to a guideline 300, and a collet 130 which operates through drive buttons 122 to control a snap ring 120 which is carried in an annular groove 124 provided in the exterior surface of housing 100 at its lower end. The outer perimeter of snap ring 120 has beveled upper and lower edges, giving it a rounded cross-section. Similarly, locking groove 420 has a rounded contour, so snap ring 120 can be pulled free of groove 420 by pulling upward on guidepost A.

Inner mandrel 200 comprises an upper portion 210 and a lower portion 220. The upper portion of mandrel 200 has a shoulder 212 used in retrieval. Guideline 300 is joined to upper portion 210 of mandrel 200 at this point or mandrel upper portion 210 can extend out of housing 100. The lower portion of mandrel 200 is provided with bent post release surface 240, and spring retaining flange 230. Lower portion 220 of mandrel 200 terminates as a frusto-conical surface 222 designed to register with and bear upon a matching frusto-conical surface 132 of collet 130.

As pointed out before, guidepost housing 100 comprises a hollow cylindrical body. The exterior surface of housing 100 is provided with holes for retrieval snap ring drive buttons 162, holes for ROV bent post release drive buttons 182, and annular ridge 140 of larger diameter than the interior diameter of guidepost-receptacle 400 to stop movement of housing 100 into guidepost-receptacle 400 in the event that the locking position is passed during insertion. The interior surface of housing 100 is provided with, at its upper end, emergency removal shoulder 170 upon which the upper end of mandrel 200 will bear for emergency release operation, upper snap ring groove 164, middle snap ring groove 184, guidepost flange 150, and holes for lower snap ring drive buttons 122. Guidepost A, comprising housing 100 and mandrel 200 further comprises a spring retained between guidepost flange 150 and mandrel flange 230. Spring 500 is a coil spring having a total capacity less than the submerged weight of the guidepost housing 100.

Guidepost-receptacle 400 comprises a hollow cylindrical housing the upper end of which flares open to act as funnel 410 to receive and guide the lower end of guidepost housing 100 into the cavity of guidepost-receptacle 400. Annular locking groove 420 on the interior surface of guidepost-receptacle 400 provides a recess into which lower snap ring 120 on the guidepost A can snap, locking guidepost A into guidepost-receptacle 400. The lower snap ring 120 is generally cylindrical with a gap between the ends which provides for the ring to be compressed to an outer diameter which is less than or equal to the interior diameter of the guidepost-receptacle 400.

The snap ring is made of spring steel and in an expanded state is designed to have an outer diameter greater than the interior diameter of guidepost-receptacle 400. The thickness of the snap ring is chosen such that in its expanded state the interior diameter of the snap ring is less than the exterior diameter of the guidepost housing 100. Snap ring 120 is positioned within a lower annular groove 124 provided in the exterior surface of the guidepost housing 100 at its lower end at a position on housing 100 which registers with an annular groove 420 provided in the interior surface of guidepost-receptacle 400 for lock down. Snap ring 120 is thereby carried within the lower groove 124 of housing 100 and securely affixed with housing 100.

Located within the lower housing groove 124 and behind snap ring 120 are a plurality of lower snap ring drive buttons 122 which have extensions 123 which extend into the interior of housing 100 through an opening provided in lower groove 124. A collet 130 is located within housing 100 the drive shoulder 131 of which bears against the extensions 123 of the drive buttons 122.

Guidepost A is held in place in guidepost-receptacle 400 by lower snap ring 120 which is outward biased and sized to fit snugly in a locking groove 420 provided on the interior surface of the guidepost-receptacle 400. Snap ring drive button 122 rests behind snap ring 120 in lower groove 124 and protrudes through to the inside of guidepost 100 where it contacts collet 130. Collet 130 is forced outward by contact at surface 132 with frusto-conical surface 222 on the mandrel lower end 220.

Guidepost A also has retrieval ring 160 and retrieval ring drive button 162 in upper groove 164. Retrieval ring 160 is normally fully seated in upper groove 164 immediately outboard of retrieval shoulder 212 on mandrel upper end 210. Guidepost A also has emergency removal shoulder 170 on its inner surface spaced vertically above retrieval shoulder 212.

The operation of the device of the present invention will now be described. Guidepost A is supported by guideline 300 by means of its attachment at the upper end 210 of mandrel 200, as guidepost A is lowered toward guidepost-receptacle 400 guided by the use of a television camera and maneuvering water jets (not shown). During this lowering step, guidepost A is supported on mandrel 200 by two means. Primarily, the weight of guidepost A is supported by the contact between surface 132 of collet 130 and frusto-conical surface 222 of mandrel lower end 220. Secondarily, a smaller portion of the weight of guidepost A is supported by coil spring 500 between guidepost flange 150 and mandrel flange 230. The total capacity of coil spring 500 is less than the submerged weight of guidepost A, so some portion of the weight is always supported by frusto-conical surface 222, ensuring the outward biasing of lower snap ring 120.

Upon arrival at guidepost-receptacle 400, guidepost lower end 112 is guided into guidepost-receptacle 400 by the help of receptacle funnel 410. Continued lowering of guidepost A into guidepost-receptacle 400 is maintained until lower snap ring 120 rests on receptacle funnel 410. Movement of guidepost A ceases at this point because lower snap ring 120 can not recede into groove 124 until pressure on snap ring driven button 122 is relieved. This is achieved by slackening of guideline 300, which, because of the weight of mandrel 200 and downward force by coil spring 500, allows mandrel 200 to drop in relation to guidepost A.

This relative dropping of mandrel 200 relieves outward pressure on collet 130, allowing it to pivot inward about its lower end 134. This inward flexing of collet 130 relieves outward pressure on snap ring drive button 122 and snap ring 120, allowing them to recede into groove 124 as guidepost A drops into its final position. The lower beveled edge of snap ring 120 causes snap ring 120 to recede into groove 124 as it bears upon funnel 410 under the weight of guidepost A. As snap ring 120 aligns with groove 420 on the inner surface of guidepost-receptacle 400, it snaps outward into groove 420. Any tension on guideline 300 pushes upward and outward on surface 132 of collet 130, increasing the outward force on snap ring 120, holding snap ring 120 securely in groove 420.

During insertion of guidepost A into guidepost-receptacle 400, it is possible that snap ring 120 can pass groove 420 because of lack of contact between collet 130 and snap ring drive button 122. In that event, guidepost A will continue into guidepost-receptacle 400 until annular ridge 140 rests upon funnel 410. Upward tension on guideline 300 will then apply upward and outward force on collet 130 and lift guidepost 100 until snap ring 120 snaps into groove 420.

Figure 2:
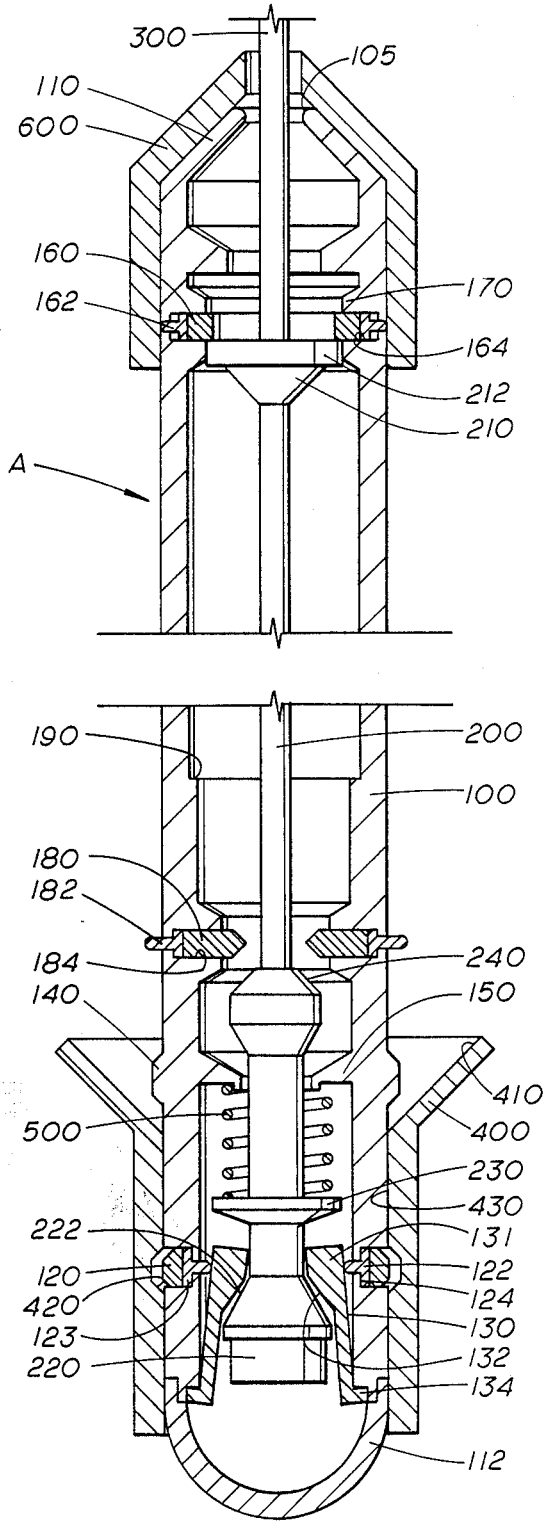
FIG. 2 is a sectional view of the latch mechanism of FIG. 1 shown in the unlatched position.

In order to normally retrieve guidepost A, referring to FIG. 2, drop collar 600 is dropped from the ocean surface along guideline 300 until it rests on the top of guidepost A, and guideline 300 is slackened. Drop collar 600 is of sufficient length and weight to slide over and depress retrieval ring drive button 162 which in turn drives retrieval ring 160 partially out of upper groove 164. Since guideline 300 has been slackened, mandrel 200 has dropped, and retrieval ring 160 protrudes over the perimeter of retrieval shoulder 212.

The aforementioned dropping of mandrel 200 relieves the outward force on collet 130 and snap ring 120, allowing snap ring 120 to be pulled free of guidepost-receptacle groove 420. As tension is applied to guideline 300 to retrieve guidepost A, retrieval shoulder 212 rises into contact with retrieval ring 160 and pushes upward on guidepost A. This causes snap ring 120, because of its rounded cross-section and the rounded contour of groove 420, to pull out of groove 420, freeing guidepost A for retrieval. This upward tension on mandrel 200 causes no outward force on snap ring 120 because the contact between retrieval shoulder 212 and retrieval ring 160 prevents surface 222 of mandrel lower end 220 from contacting surface 132 of collet 130 to force collet 130 outward. Guidepost A rides to the surface on retrieval ring 160 and retrieval shoulder 212.

Figure 3:
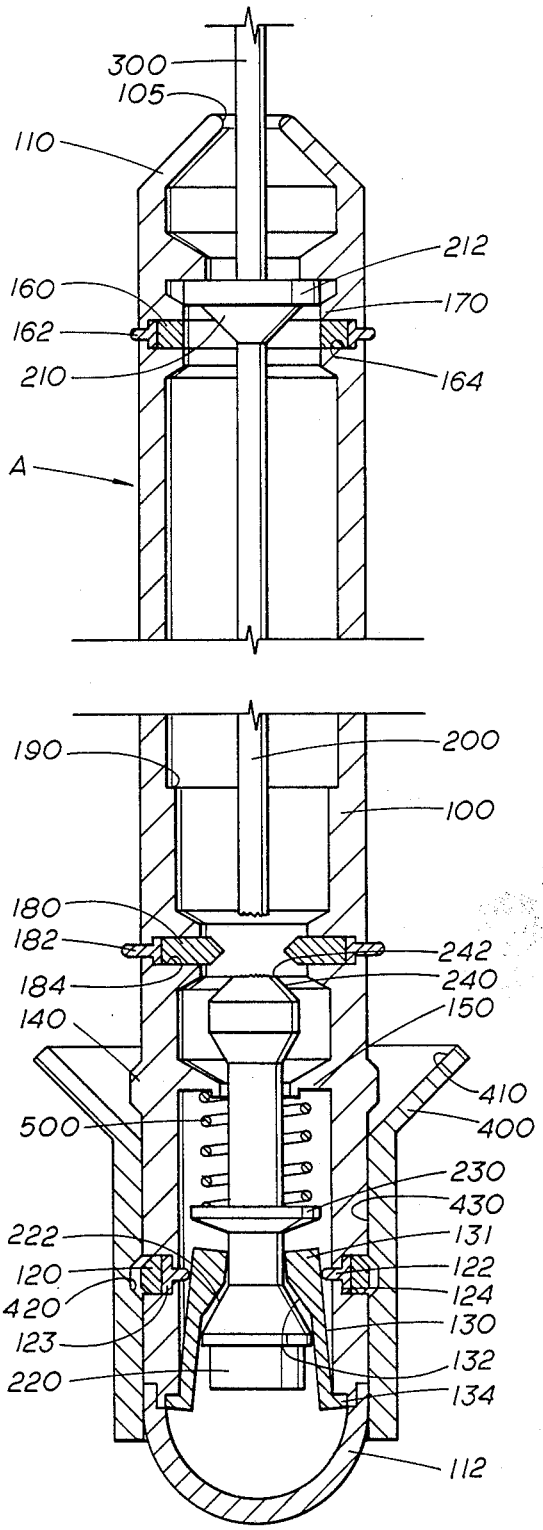
FIG. 3 is a sectional view of the latch mechanism of FIG. 1 showing the emergency breakpoint of the mandrel.
Figure 4:
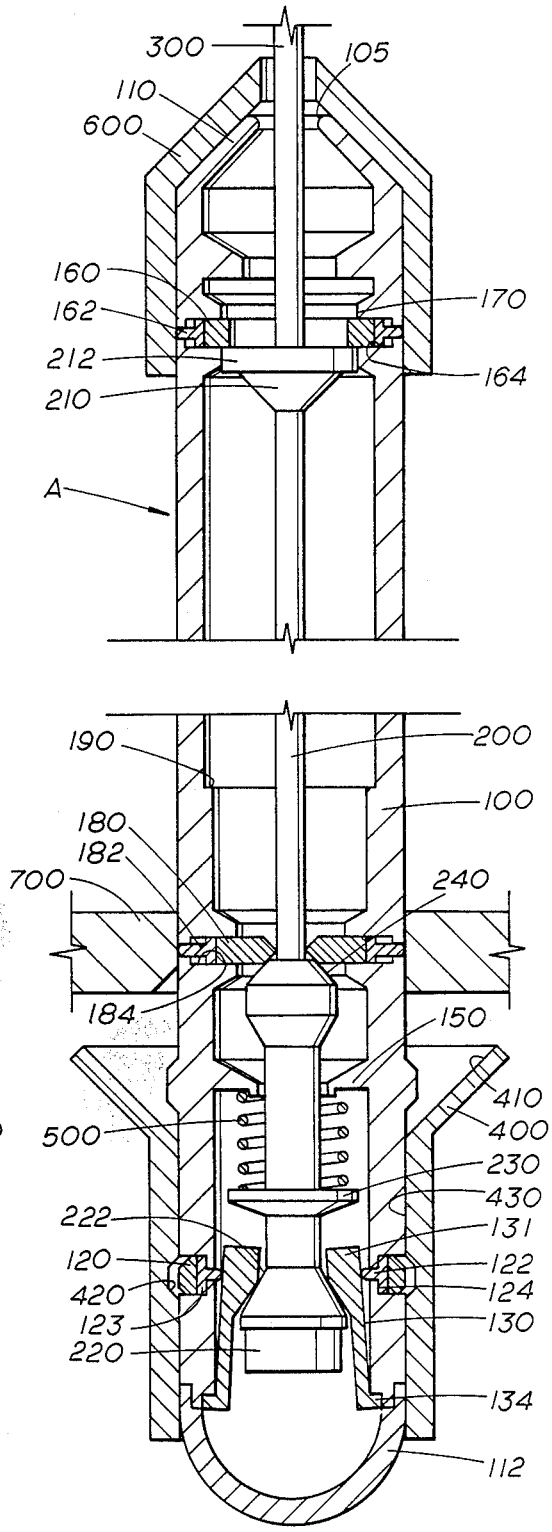
FIG. 4 is a sectional view of the latch mechanism of FIG. 1 showing operation of the release pins.

Rather than using the normal retrieval method described above, emergency retrieval is effected by simply increasing the tension on the guideline. Referring now to FIG. 3, mandrel 200 has a machined surface 242 designed to break at a tensile stress lower than the yield strength of the guideline 300. As tension on guideline 300 is increased to this yield point, mandrel 200 parts at surface 242 and mandrel lower end 220 drops with the assistance of force of spring 500, releasing the outward force on collet 130 and snap ring 120. Simultaneously, mandrel upper end 210 rises until retrieval shoulder 212 contacts emergency removal shoulder 170 on the interior of guidepost housing 100. This applies upward force on guidepost A, pulling snap ring 120 free of guidepost-receptacle groove 420. Guidepost A then rides to the surface on emergency removal shoulder 170.

Finally, if sideways forces are applied to guidepost A sufficient to cause it to bend, mandrel 200 can become stuck and fail to drop when guideline 300 is slackened in preparation for retrieval. Guidepost housing 100 is designed with increased wall thickness below point 190 to insure that any bending will take place high enough not to affect the operation of the lower half of mandrel 200. Bent post release wedges 180 and their associated drive buttons 182 are arranged in middle groove 184 so that the tapered surfaces on the inner ends of wedges 180 align with frusto-conical bent post release surface 240 on mandrel 200. As seen in FIG. 1, in normal latched position, wedges 180 contact surface 240 at its lower, outer edge.

When retrieval of a bent post is required, guideline 300 is slackened. A remotely operated vehicle well known in the trade is positioned near the bent guidepost, and hydraulic tool 700 on the remotely operated vehicle is used to depress wedge drive buttons 182. This drives wedges 180 inward, forcing mandrel 200 downward as wedges 180 slide along surface 240 of mandrel 200. This downward motion of mandrel 200 releases snap ring 120 in the normal fashion. Guidepost A can then be retrieved by use of a drop collar 600 or a drill-pipe-mounted overshot (not shown).

The drawings and description given here address a preferred embodiment of this invention. Variations will become obvious to those skilled in the art. To the extent that such variations are equivalent, it is intended that they be encompassed by the following claims.

I claim:

1. A subsea latch mechanism, comprising:

a hollow guidepost;

an outward biased snap ring arranged circumferentially around the guidepost in an annular groove on the outer surface of the guidepost;

a cylindrical collet inside the guidepost and inside the snap ring, contacting the inner diameter of the snap ring through an opening in the annular groove on the guidepost;

a mandrel inside the guidepost, coaxial with the guidepost and running substantially the length thereof; and means on the lower end of the mandrel for selectively bearing against the inner diameter of the collet, expanding the collet outward against the snap ring when the mandrel is pulled upward, and for selectively allowing the collet to contract when the mandrel lower end drops.

2. The latch mechanism of claim 1, further comprising:

a guideline attached to the top of the mandrel; and a cylindrical guidepost-receptacle for receiving the guidepost, having an annular groove on its inner surface for receiving the snap ring.

3. The latch mechanism of claim 2, further comprising an annular ridge on the outer surface of the guidepost above the snap ring, having an outer diameter greater than the inner diameter of the cylindrical guidepost-receptacle to prevent insertion of the guidepost beyond a maximum desired insertion into the guidepost-receptacle.

4. The latch mechanism of claim 1, further comprising means for biasing the mandrel downward with respect to the guidepost.

5. The latch mechanism of claim 4, wherein the means for biasing is a coil spring having one end bearing against the mandrel and the other end bearing against the guidepost.

6. The latch mechanism of claim 1, further comprising:

an outwardly biased retrieval ring arranged in an annular groove on the inner surface of the guidepost;

protuberances on the outer diameter of the retrieval ring protruding ththroug the guidepost to the outer surface thereof, which when depressed inward will bias the retrieval ring inward to a retrieval position;

a drop-collar shaped to fit over the top of the guidepost and depress the protuberances on the retrieval ring protruding through the guidepost; and an annular shoulder on the upper end of the mandrel which bears upwardly against the retrieval ring when the retrieval ring is in the retrieval position.

7. The latch mechanism of claim 2, further comprising:

an annular shoulder on the inner surface of the guidepost for emergency removal of the guidepost from the guidepost-receptacle;

an annular shoulder on the upper end of the mandrel spaced vertically below the annular shoulder on the inner surface of the guidepost, which bears against the shoulder on the inner surface of the guidepost in the event that the mandrel breaks; and a stress riser located between the upper and lower ends of the mandrel designed to cause the mandrel to part at that location before any other, upon increased tension on the mandrel.

8. The latch mechanism of claim 1, further comprising means for forcing the lower end of the mandrel downward by applying force external to the guidepost.

9. The latch mechanism of claim 8, wherein the means for forcing the lower end of the mandrel downward comprises:

an annular frusto-conical surface on the mandrel proximal the lower end thereof;

at least one release pin extending through the guidepost wall;

an inner end on the release pin positioned to bear against the frusto-conical surface on the mandrel and drive the mandrel downward as the release pin is driven into the interior of the guidepost;

an outer end on the release pin protruding from the outer surface of the guidepost; and means for pressing on the outer end of the release pin to drive the release pin into the interior of the guidepost.

10. The latch mechanism of claim 1, wherein:

the collet has an interior frusto-conical surface with its smaller diameter on top; and the lower end of the mandrel has an exterior frusto-conical surface mating with the interior frusto-conical surface on the collet so that when the mandrel is pulled upward, it progresses upward relative to the collet, progressively expanding the collet outward against the snap ring.

11. A guideline guidepost which is lockable to a guidepost receptacle by engagement of a snap ring to a guidepost receptacle locking groove and releaseable from the locking engagement when tension is released from an attached guideline, comprising:

a hollow guidepost housing having on its lower exterior surface an annular groove in which a plurality of drive buttons are carried, a first end of each of the button in bearing contact with a snap ring carried in the annular groove and a second end of each of the buttons extending through an opening in the annular groove into the housing to bear on a cylindrical collet; the housing having on its interior surface an upper interior bearing shoulder surface and there below a spring retaining flange;

the outer surface of the collet positioned to bear against the second end of each drive button and the inner surface of the collet being frusto-conical;

a mandrel inside and coaxial with the housing, the mandrel having means on its upper end for securing thereto a guideline and for bearing against the upper interior bearing shoulder surface of the housing, a spring retaining flange, and a lower frusto-conical end surface complimentary to the inner frusto-conical surface of the collet; and a spring retained between the spring retaining flange of the housing and the spring retaining flange of the mandrel.

12. The guideline guidepost of claim 11, further comprising:

an upper annular groove on the inner surface of the housing near the upper end of the housing;

a retrieval ring in the upper annular groove properly sized to lie entirely within the upper annular groove in its normal state;

retrieval ring drive buttons in the upper annular groove bearing on a first end against the outer perimeter of the retrieval ring and having a second end protruding through openings to the exterior of the housing; and a hollow drop collar sized to slide down the guideline over the top of the guidepost and depress the retrieval ring drive buttons, thereby compressing the retrieval ring into the interior of the housing to bear against the upper end of the mandrel.

13. The guideline guidepost of claim 11, further comprising:

an upper frusto-conical surface on the mandrel, having its minor diameter above its major diameter;

bent-post release wedges extending from the exterior of the housing to the interior of the ho; using in alignment with the upper frusto-conical surface on the mandrel; and the release wedges positioned so that when driven into the interior of the housing by application of force on a first end of each wedge outside the housing, a second end of each wedge on the interior of the housing will contact the upper frusto-conical surface on the mandrel near its major diameter, progress along the frusto-conical surface toward its minor diameter, driving the mandrel downward.

14. A method of installation of a guidepost, comprising the steps of:

attaching a guideline to the top of a mandrel positioned within a hollow guidepost;

lowering the guidepost until its lower end enters a hollow guidepost-receptacle, with an external snap ring on the guidepost resting on top of the guidepost-receptacle;

further lowering the guideline to release tension on the mandrel, allowing the mandrel to drop in relation to the guidepost and to regress from a collet inside the guidepost which allows the collet to contract, in turn allowing the external snap ring to recede into the guidepost; and further lowering the guidepost until the snap ring aligns with, and snaps outwardly into an annular groove on the interior of the guidepost-receptacle.

15. A method for retrieval of a guidepost from a guidepost-receptacle comprising the steps of:

dropping a drop-collar down a guideline onto a hollow cylindrical guidepost having an interior mandrel which is attached to the guideline, until the drop-collar rests on retrieval buttons protruding from the outer surface of the guidepost;

releasing tension on the guideline, allowing the mandrel to drop which allows the drop-collar to drop further and depress the retrieval buttons, thereby engaging a retrieval ring in the guidepost with a shoulder on the upper end of the mandrel, while the dropping of the lower end of the mandrel also releases a collet in the guidepost to contract, in turn releasing outward pressure on an external snap ring on the guidepost; and applying tension on the guideline to pull the shoulder on the mandrel against the retrieval ring which in turn pulls upwardly on the guidepost, disengaging the snap ring from an internal groove in the guidepost-receptacle.

16. The method of claim 15, wherein the mandrel fails to drop when tension on the guideline is released, further comprising the steps of:

increasing tension on the guideline until the mandrel parts between its upper and lower ends, allowing the lower end of the mandrel to drop, thereby releasing the collet and the snap ring; and pulling upwardly on the guideline to raise the upper end of the mandrel until the shoulder on the upper end of the mandrel engages an annular shoulder on the inner surface of the guidepost, thereby raising the guidepost and disengaging the snap ring from the internal groove on the guidepost-receptacle.

17. The method of claim 15, wherein the guidepost has become bent, causing the mandrel to lodge in place, further comprising the steps of:

lowering a remotely operated vehicle adjacent to the guidepost-receptacle;

by means of the remotely operated vehicle depressing a button on the outer surface of the guidepost, driving a release pin into the interior of the guidepost to engage a frusto-conical surface on the mandrel and drive the mandrel downward, thereby releasing the collet and the snap ring; and pulling upwardly on the guideline to engage the guidepost retrieval ring with the mandrel shoulder, disengaging the snap ring from the internal groove on the guidepost-receptacle.

* * * * *